United States Patent [19]

Galtz et al.

[11] Patent Number: 4,932,834

[45] Date of Patent: Jun. 12, 1990

[54] RING CHANNEL BLOWER

[75] Inventors: Ruediger Galtz, Graefelfing; Wolfgang Jentzsch, Starnberg, both of Fed. Rep. of Germany

[73] Assignee: Webasto AG Fahrzeugtechnik, Gauting, Fed. Rep. of Germany

[21] Appl. No.: 318,542

[22] Filed: Mar. 3, 1989

[51] Int. Cl.[5] ..... F04D 5/00

[52] U.S. Cl. ..... 415/55.1

[58] Field of Search ..... 415/55.1, 55.3, 55.4

[56] References Cited

U.S. PATENT DOCUMENTS

| | | | |
|---|---|---|---|
| 3,356,033 | 12/1967 | Ullery | 415/55.4 |
| 3,942,906 | 3/1976 | Schonwald | 415/55.4 |
| 3,989,411 | 11/1976 | Middleton | 415/55.4 |
| 4,376,613 | 3/1983 | Schoenwald | 415/55.2 |
| 4,408,952 | 10/1983 | Schweinfurter | 415/55.1 |
| 4,412,781 | 11/1983 | Abe et al. | 415/55.4 |
| 4,456,423 | 6/1984 | Mittmann | 415/55.4 |
| 4,749,338 | 6/1988 | Galtz | 415/145 |

FOREIGN PATENT DOCUMENTS

| | | |
|---|---|---|
| 2531740 | 2/1977 | Fed. Rep. of Germany . |
| 56-594 | 1/1981 | Japan . |
| 2104959 | 3/1983 | United Kingdom . |

*Primary Examiner*—Carl D. Price

*Assistant Examiner*—Jon T. Kwon

*Attorney, Agent, or Firm*—Sixbey, Friedman, Leedom & Ferguson

[57] ABSTRACT

A ring channel blower in which, in the discharge area of the ring channel blower, a cross piece-shaped interrupter has a discharge side boundary edge that is configured such that between the inner edge of the ring channel and the facing edge of the respective vanes of the impeller as they pass thereover an angle of at least 25° is initially enclosed and this angle increases gradually to 90° when the intersection of the boundary edge and facing impeller vane edge is at the outer edge of the impeller. The discharge side boundary edge incorporates an inner end section that is approximately tangent to the inner edge of the ring channel and an outer end section that is approximately tangent to the outer edge of the impeller, and both of these tangent sections are connected to each other by a circular arc section. The cross piece-shaped interrupter forms, in the inlet area of the ring channel blower, an inlet side boundary edge that is configured such that the conveyed medium, during the rotational movement of the impeller, first enters the ring channel near the inner edge thereof and then enters near the outer edge of the ring channel, and only afterwards is the total cross section of the ring channel opened for the entry of the conveyed medium.

20 Claims, 1 Drawing Sheet

FIG. 1
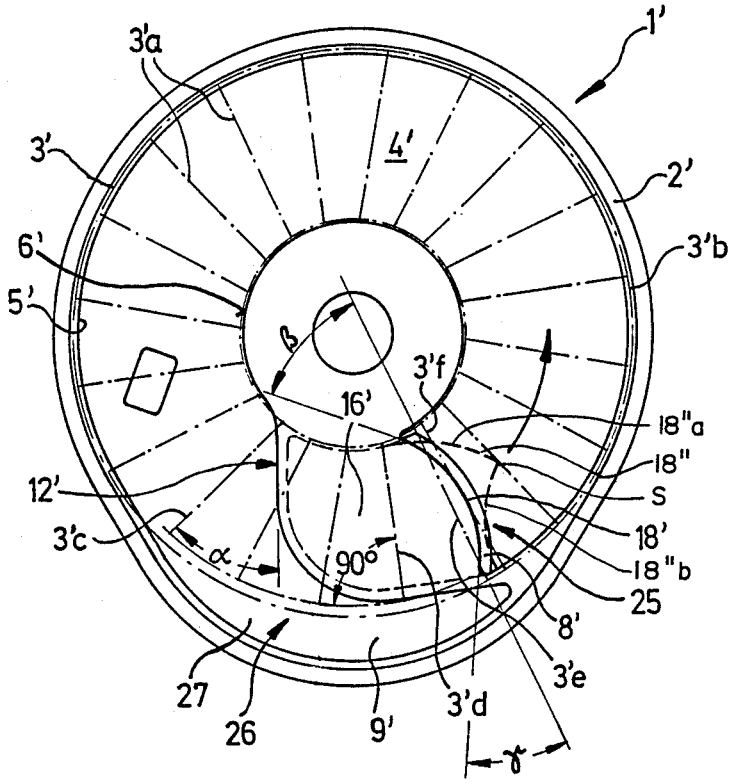
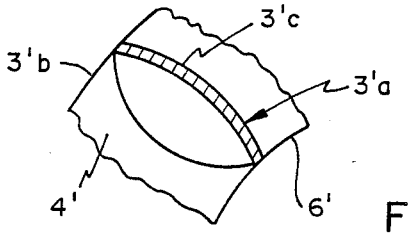
FIG. 2

RING CHANNEL BLOWER

BACKGROUND OF THE INVENTION

The invention relates generally to a ring channel blower, also known as a side channel blower or lateral duct fan, that is intended, in particular, for combustion air conveyance in heaters, such as motor vehicle heaters. More specifically, the invention is directed to a ring channel blower that has a ring channel formed in a housing part that has an inlet opening and a discharge opening as well as a cross piece-shaped interrupter lying between them, and a rotatable impeller with vanes whose edges face the ring channel.

A ring channel blower of the type mentioned above is known from U.S. Pat. No. 4,749,338. The cross piece-shaped interrupter between the inlet opening and the discharge opening in this ring channel blower is bounded by two boundary edges that run approximately parallel to each other, are made there as straight lines and run approximately in the direction of the diameter of the ring channel. It has been shown that such a ring channel blower operates relatively noisily, which is increasingly felt to be especially inconvenient when, corresponding to current efforts by motor vehicle producers, the passenger compartment is becoming more quiet by soundproofing. Especially with the use of such a ring channel blower in a motor vehicle heater, its operation can be perceived in the passenger compartment of the motor vehicle. This can essentially be ascribed to the fact that the abrupt transition from the essentially straight boundary edges of the interrupter to the discharge opening and/or to the inlet opening, produces flow noises that have frequencies in the audible range.

Also known (from German Offenlegungsschrift No. 25 31 740 and corresponding U.K. Application No. 2,104,959) is a ring channel blower with a cross piece-shaped interrupter having nonuniform boundary edges which progressively uncover/cover the ring channel at the inlet/discharge areas via sections which taper toward the middle of the ring channel in a direction downstream/upstream relative to the inlet/outlet of the ring channel and which may have a V-shaped central notching at the free ends thereof. While producing somewhat less abrupt transitions, such a blower also operates relatively noisily. The same is also true for the V shape of the boundary edges of U.S. Pat. No. 4,412,781 and the concave shape shown in Japanese Patent Publication No. 56-594, both of these blowers requiring noise suppressing mufflers.

SUMMARY OF THE INVENTION

Thus, a primary object of the invention is to provide a ring channel blower of the type initially described above whose noise emission is extensively reduced.

According to a preferred embodiment of the invention, a ring channel blower, in particular for combustion air conveyance in heaters, such as motor vehicle heaters of the type provided with a ring channel in a housing part that has an inlet opening and a discharge opening as well as a cross piece-shaped interrupter lying between them and with an impeller that carries vanes, whose edges face the ring channel, is improved by the section of the interrupter at the discharge area being formed with a boundary edge that is approximately tangent to the outer edge of the impeller and the angle enclosed between the inner edge of the ring channel and a facing edge of the impeller vanes is at least 25°, this angle increasing as the edge of the impeller moves across the boundary edge in the discharge direction so that it is about 90° when the outer edge of the impeller intersects the boundary edge.

The ring channel blower according to the invention achieves, by virtue of the design of the boundary edge, a gradual transition in the ring channel to the discharge opening at the discharge area of the interrupter so that, surprisingly, flow noises can extensively be suppressed. Thus, the noise level of such a ring channel blower during operation can be greatly reduced. Simultaneously, a performance reduction can be avoided, since the peripheral extension of the cross piece-shaped interrupter is as small as possible with respect to the achievable pressure and the interrupter has a width that corresponds to about the distance between two consecutive vanes of the impeller. If such a ring channel blower is used, in particular in a heater to be installed in a motor vehicle, the noises generated during operation of the ring channel blower can hardly be perceived in the passenger compartment of the motor vehicle.

An ideal course of the boundary edge of the interrupter at the discharge area would be obtained if the angle enclosed between the inner edge of the ring channel and the facing edge of the impeller's vanes would increase uniformly, starting from about 25°, to on the order of about 90° at the outer edge. The course of such a boundary edge could, for example, be formed by a logarithmic spiral. But the production and processing necessary for this are very extravagant and expensive.

According to a preferred embodiment of the invention, a compromise has been struck for adaptation to the actual circumstances with consideration for production expenses. In this embodiment, the boundary edge of the interrupter is made so that it goes from the inner edge of the ring channel as a tangent to it and merges by a radius, i.e., a circular section, with a tangent to the outer edge of the impeller in the area of the discharge opening. To this end, the boundary edge of the interrupter in the discharge area incorporates two straight sections, namely the tangent to the inner edge of the ring channel and the tangent to the outer edge of the impeller in the area of the discharge opening, which are connected to each other by a circular section suitably selected to achieve a uniform transition from the straight sections to the curved section. The production engineering expense necessary for making such a boundary edge is economically feasible compared to the noise reduction achieved.

To further reduce the noise emission in such a ring channel blower, according to the invention the boundary edge formed from the cross piece-shaped interrupter at the inlet area is also suitably shaped. In particular, the boundary edge of the cross piece-shaped interrupter at the inlet area is made so that, seen in the inflow direction, the ring channel gradually opens going out from its inner edge as well as from its outer edge. In other words, this means that the boundary edge at the inlet area is made so that the vane channel, i.e., the space formed, in each case, between two vanes of the impeller that are consecutive in the movement direction, is successively cleared at the inner edge of the impeller as well as at the outer edge of the impeller, while the area in the middle of the vane edge is still closed by the interrupter at the inlet area.

To achieve as quiet as possible an air inflow in the inlet area of the ring channel blower, the boundary edge of the interrupter is preferably made, at the inlet area to the ring channel, so that the ring channel first opens, seen in the rotational direction of the impeller, i.e., in the inflow direction, at the area facing the inner edge and then on the area facing the outer edge. This means that the vane channel, seen in the rotational direction, is cleared first in the area of the inner edge and then in the area of the outer edge. Preferably, this opening difference or this clearing difference is about half the space between the vanes of the impeller.

Preferably the design is further made so that the ring channel opens completely at about midway between its inner and outer edge, which means that, with the boundary edge at the inlet area, the vane channel is first completely open about in the middle area of the allocated impeller vane edge. Put another way, the middle area of the ring channel is the last to be cleared of the inlet interrupter section. By the preferred embodiment of the inlet area of the ring channel blower, explained above, it is achieved that the air drawn in by the inlet opening gradually flows into the ring channel, to also reduce the flow noises in the inlet area.

It has proven especially advantageous when, at the inlet area, the angle enclosed between the facing vane edges of the impeller vanes and the boundary edge of the interrupter at the inner edge of the ring channel is larger than that enclosed between these vane edges and the boundary edge at the outer edge. Thus, the angle enclosed between the boundary edge at the outer edge and the vane edge can be as much as about 30°, while the angle enclosed between the boundary edge at the inner edge and the vane edge can be, for example, in a range up to about 75°, i.e., it can be selected as large as possible.

Such a design of the boundary edge at the inlet area of the ring channel blower is the most favorable from a production engineering viewpoint if this boundary edge has a uniformly curved course, for example, is made of a circular arc section of constant radius. In such a case, the angle enclosed between the boundary edge at the inner edge of the ring channel and the vane edge is preferably about 45°. Alternatively, it has also been found that a nonuniform course of the boundary edge also leads to noise emission reduction, and the design may suitably be made so that, with a nonuniform course of the boundary edge, the boundary curves forming the boundary edge intersect about in the middle between the outer and inner edge of the ring channel, or so that this intersection of the boundary curves is closer to the inner edge than to the outer edge.

Preferably, the vanes of the impeller of the ring channel blower are inclined in the axial direction of the impeller and in the rotational or flow direction. In connection with such a design of the vanes on the impeller, the noises of such a ring channel blower can be reduced in an especially advantageous way in conjunction with the advantageous design of the boundary edge at the discharge area, i.e., of the discharge contour, and at the inlet area, i.e., of the inlet contour.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 of the drawing is a top view on a housing part of the ring channel blower according to a preferred embodiment and, for simplicity, the impeller is represented by dot-dash lines.

FIG. 2 is a partial sectional view of the blower of FIG. 1, illustrating an impeller vane which is inclined in bith axial and rotational directions.

DETAILED DESCRIPTION OF THE PREFERRED EMBODIMENT

FIG. 1 shows a housing part 2' of a ring channel blower 1' with an impeller 3', represented in dot-dash line outline form, carrying vanes 3'a, and being rotatable in the direction indicated by the counterclockwise directed arrow. In housing part 2' there is provided a ring channel 4' of an approximately semicircular cross-sectional shape. The vanes 3'a face the ring channel so that rotational movement of impeller 3' causes its vanes 3'a to interact with ring channel 4' so that the surrounding air is drawn in at an inlet opening 8' and enters the channel 4' in the form of a spiral flow, at an inlet area 25 and, in conjunction with vanes 3'a of impeller 3', is compressed and conveyed to a discharge area 26 of the ring channel 4', where the air exits via a discharge opening 9'. In the embodiment shown, the discharge opening 9' opens in the peripheral direction of housing part 2', i.e., discharge opening 9' points away from ring channel 4' in the radial direction.

More precisely, between outer edge 3'b of impeller 3' and outer edge 5' of ring channel 4' in discharge area 26, there is a slit-shaped space 27 by which the medium, in particular air, that is conveyed and compressed with the aid of ring channel blower 1', exits.

A cross piece-shaped interrupter 16' is provided on the side of ring channel 4' proximate impeller 3' at a location between inlet opening 8' and discharge opening 9'. This interrupter 16' has a boundary edge 12' at discharge area 26 of ring channel 4', which extends from inner edge 6' of ring channel 4' in the area of discharge opening 9' in the direction of outer edge 5' of ring channel 4'. To the extent described so far, the blower of the present invention conforms with that shown and described in U.S. Pat. No. 4,749,338 which is hereby incorporated by reference to the extent necessary to complete an understanding of the present invention.

The boundary edge 12' has, in the example shown, a course such that it encloses a discharge blade angle of about 25°, at the inner edge 6' of ring channel 4', with respect to a facing edge 3'c of vanes 3'a of impeller 3'. In the Figure, the edges represented by 3'c of vanes 3'a of impeller 3' are to be understood as their projection on ring channel 4'. Seen in the rotational direction of impeller 3', this discharge blade angle, which is designated in the drawing by $\alpha$, becomes gradually larger as the vane edges 3'c move across the boundary edge 12, until it is about 90° when their intersection is located at their outer ends in discharge area 26 or in the area of discharge opening 9', such as is shown in connection with the edge represented by 3'd of vanes 3'a of impeller 3'. Boundary edge 12' is thus made to be approximately in the form of a tangent to outer edge 3'b of impeller 3'at discharge area 26. As represented in the Figure, angle $\alpha$, deviating from the ideal course, approaches a continuous increase to 90° in the form of a logarithmic spiral by a tangent section to inner edge 6' of ring channel 4' and a tangent section to outer edge 3'b of impeller 3', and both tangent sections are connected by a suitable radius or a circular arc section.

By virtue of this design of boundary edge 12' of interrupter 16' at discharge area 26 of ring channel blower 1', at the compression end of ring channel 4', a sudden pressure surge is avoided as the air exits to discharge opening 9', since the air conveyed in ring channel 4' is moved gradually to discharge opening 9'. This makes it possible to reduce whistling and flow noises at discharge area 26 of ring channel blower 1'.

Cross piece-shaped interrupter 16' has, at inlet area 25 of ring channel blower 1', a boundary edge 18'. This boundary edge 18' advantageously has, in the example represented, a uniformly curved course and is preferably formed from a circular arc section. More precisely, boundary edge 18' has a course such that, seen in the inflow direction or in the rotational direction of impeller 3' (see arrow), it goes out from inner edge 6' of ring channel 4' so that it encloses an inner inlet blade angle $\beta$. At outer edge 5' of ring channel 4', boundary edge 18' ends so that it encloses an outer inlet blade angle $\gamma$ with outer edge 5'. Inner inlet blade angle $\beta$ is larger than outer inlet blade angle $\gamma$. Relative to a vane edge 3'e, represented diagrammatically in this inlet area 25 of ring channel blower 1', the angle enclosed with outer edge 5' is about 30° and the angle enclosed with inner edge 6' is about 45°. Seen in the inflow direction, the middle section of boundary edge 18' is convexly curved.

If a vane edge of vanes 3'a of impeller 3' assume, for example, the position represented by 3'e in inlet area 25 of ring channel blower 1', then air drawn into ring channel 4' can enter near inner edge 6', i.e., in the area of angle $\beta$, into a vane channel that is not represented in more detail, is bounded by two neighboring vanes 3'a of impeller 3', and is formed in conjunction with ring channel 4'. At outer edge 5' of ring channel 4', in contrast, vane edge 3'e is still sealed by cross piece-shaped interrupter 16', since angle $\gamma$ enclosed there is smaller and the vane channel is still covered by boundary edge 18'. If the vane boundary edge of vane 3'a of impeller 3' assumes the position designated by 3'f, air can also enter at the area of outer edge 5'. The middle area of vane edge 3'f, in contrast, is still covered by boundary edge 18'. Only when impeller 3' rotates further in the direction of the arrow is the total cross section of ring channel 4' cleared of boundary edge 18'.

By this design of boundary edge 18', at inlet area 25 of ring channel blower 1', it is achieved that the air drawn in does not reach the vane channel or ring channel 4' instantaneously and suddenly, but rather, seen in the rotational direction of impeller 3' (see arrow), the air first can enter near inner edge 6', then near outer edge 5', and then increasingly until, ultimately. it enters across the total channel width. The distance between the point of opening to ring channel 4' near inner edge 6' and the point of clearing of ring channel 4' in the area of outer edge 5', i.e., the distance measured peripherally, is about half the space between the vanes 3'a of impeller 3'. As a result, gradual entry of the conveyed medium, such as air, is produced in inlet area 25 of ring channel blower 1', so that pressure surges and noises are prevented in inlet area 25. Despite this embodiment of interrupter 16' with boundary edge 12' at discharge area 26 and with boundary edge 18' at inlet area 25 of ring channel blower 1', the width of cross piece-shaped interrupter 16', measured peripherally, is as small as possible and corresponds to about the distance between two neighboring vanes 3'a of impeller 3'. By this, it is achieved that the conveying efficiency of ring channel blower 1' is essentially no less favorable a compared to that which was previously achieved.

As represented in broken lines in the drawing, boundary edge 18'', at inlet area 25 of blower 1', can also have a nonuniform course. This means that boundary edge 18'', in this case, comprises partial curves 18''a and 18''b with varying curvatures. In such a case, the design is to be advantageously made so that these varying partial curves 18''a and 18''b intersect about near the middle of ring channel 4'. If this is not possible because of the varying curvature, then the intersection are of these varying partial curves 18''a and 18''b should be closer to the inner edge 6' than to the outer edge 5' of ring channel 4', to achieve the object sought according to the invention, i.e., that the middle area of ring channel 4' is the last cleared by the vane edges of the respective vane 3'a of impeller 3'. In this case, angle $\beta$ enclosed between the boundary edge 18', 18'' vane edge 3'e, when they intersect at the inner edge 6', is selected to be as large as possible, and it can be in a range up to about 75° or more.

At the inlet area of ring channel blower 1' the design is made so that, as already explained above, the medium to be conveyed, such as air, can flow in first near inner edge 6', then near outer edge 5' and finally through the whole cross section of ring channel 4'.

Taking the essential aspects according to the invention into consideration, of course still other embodiments of ring channel blower 1' are possible with respect to boundary edge 12' of interrupter 16' at discharge area 26 and also with respect to boundary edge 18' of cross piece-shaped interrupter 16' at inlet area 25, which partially depend on the blower base construction and which one skilled in the art would discover if need be. As such, the present invention should not be viewed as limited to the specific details shown and described, but rather encompasses the full scope of the claims appended hereto.

We claim:

1. Ring channel blower for combustion air conveyance in heaters, such as motor vehicle heaters, with a ring channel in a housing part that has an inlet opening and a discharge opening as well as a cross piece-shaped interrupter lying between them, and with an impeller that carries vanes with edges that face the ring channel, wherein said interrupter has a discharge boundary edge in a discharge area which encloses a discharge blade angle with a facing edge of respective vanes of the impeller as they are disposed in said discharge area, said discharge blade angle being at least 25° at an initial point of intersection between the boundary edge and the facing edge of said respective vanes at an inner edge of the ring channel, and increases, as the respective vanes proceed through the discharge area in a discharge direction, to about 90° at a final point of said intersection at an outer edge of the impeller so that the boundary edge forms approximately a tangent to the outer edge of the impeller.

2. Ring channel blower according to claim 1, wherein said discharge side boundary edge forms a tangent with an inner edge of the ring channel at an inner end of said boundary edge, and merges via a radius with the outer edge of the ring channel at an outer end of the boundary edge so as to be tangentially oriented relative to the impeller outer edge.

3. Ring channel blower according to claim 1, wherein the cross piece-shaped interrupter has, at an inlet area, an inlet side boundary edge which, seen in an inflow direction, gradually uncovers the ring channel, going from the inner edge of the ring channel as well as from its outer edge, toward the middle of the ring channel.

4. Ring channel blower according to claim 3, wherein the inlet side boundary edge uncovers the ring channel at the inner edge of the ring channel before it uncovers the ring channel at the outer edge.

5. Ring channel blower according to claim 4, wherein a peripheral distance along the ring channel travelled by a vane of the impeller between opening of the ring channel at the inner edge and at the outer edge thereof corresponds to about half a separation distance between adjacent vanes of the impeller.

6. Ring channel blower according to claim 5, wherein the ring channel is last uncovered, so as to be completely open, at about midway between its inner and outer edges.

7. Ring channel blower according to claim 6, wherein an inner inlet area angle enclosed between the inlet side boundary edge of the interrupter and respective facing vane edges of the vanes of the impeller as the respective vanes proceed over the inlet side boundary edge at the inner edge of the ring channel is larger than an outer inlet area angle between the vane edges and the boundary edge at the outer edge of the ring channel.

8. Ring channel blower according to claim 7, wherein said outer inlet area angle is about 30°.

9. Ring channel blower according to claim 8, wherein said inner inlet area angle is in a range up to 75°.

10. Ring channel blower according to claim 7, wherein said inner inlet area angle is in a range up to 75°.

11. Ring channel blower according to claim 7, wherein a peripheral distance along the ring channel travelled by a vane of the impeller between opening of the ring channel at the inner edge and at the outer edge thereof corresponds to about half a separation distance between adjacent vanes of the impeller.

12. Ring channel blower according to claim 7, wherein the inlet side boundary edge curves nonuniformly and with differing curvatures thereof intersecting at about midway between the outer and inner edges of the ring channel.

13. Ring channel blower according to claim 7, wherein the inlet side boundary edge curves nonuniformly and with differing curvatures thereof intersecting closer to the inner edge of the ring channel than to the outer edge of the ring channel.

14. Ring channel blower according to claim 7, wherein the vanes of the impeller are inclined in both axial and rotational directions of the impeller.

15. Ring channel blower according to claim 4, wherein an inner inlet area angle enclosed between the inlet side boundary edge of the interrupter and respective facing vane edges of the vanes of the impeller as the respective vanes proceed over the inlet side boundary edge at the inner edge of the ring channel is larger than an outer inlet area angle between the vane edges and the boundary edge at the outer edge of the ring channel.

16. Ring channel blower according to claim 15, wherein the inlet side boundary edge has a uniform curvature.

17. Ring channel blower according to claim 16, wherein the curvature of the inlet side boundary edge is a circular arc section.

18. Ring channel blower according to claim 17, wherein the outer inlet area angle is about 45°.

19. Ring channel blower according to claim 16, wherein the outer inlet area angle is about 45°.

20. Ring channel blower according to claim 1, wherein the vanes of the impeller are inclined in both axial and rotational directions of the impeller.

* * * * *